United States Patent [19]

Talarico, II

[11] Patent Number: 4,578,882

[45] Date of Patent: Apr. 1, 1986

[54] FOREFOOT COMPENSATED FOOTWEAR

[76] Inventor: Louis C. Talarico, II, 116 Wood St., P.O. Box 180, Lewiston, Me. 04240-0180

[21] Appl. No.: 636,194

[22] Filed: Jul. 31, 1984

[51] Int. Cl.[4] ..... A43B 5/00; A43B 13/38

[52] U.S. Cl. ..... 36/103; 36/25 R; 36/30 R; 36/43; 36/127; 128/584

[58] Field of Search ..... 36/103, 25, 88, 43, 36/114, 93, 30 R, 127, 113, 32 R; 128/584, 585

[56] References Cited

U.S. PATENT DOCUMENTS

| | | | |
|---|---|---|---|
| 1,039,396 | 9/1912 | Hilgert | 36/43 |
| 1,137,092 | 4/1915 | Sharp | 36/43 |
| 1,958,097 | 5/1934 | Shaw | 128/585 |
| 2,008,207 | 7/1935 | Greenberg | 36/43 |
| 2,052,115 | 8/1936 | Shurman | 36/25 R |
| 2,216,630 | 10/1940 | Saber et al. | 128/584 |
| 2,847,769 | 8/1958 | Schlesinger | 36/127 |
| 4,180,924 | 1/1980 | Subotnick | 36/127 |
| 4,240,214 | 12/1980 | Sigle et al. | 36/43 |
| 4,333,472 | 6/1982 | Tager | 128/581 |

FOREIGN PATENT DOCUMENTS

| | | | |
|---|---|---|---|
| 981902 | 1/1976 | Canada | 128/584 |
| 1029264 | 4/1958 | Fed. Rep. of Germany | 36/43 |
| 1141593 | 9/1957 | France | 36/127 |

OTHER PUBLICATIONS

"The Evolutionary & Phylogenetic Development of the Lower Extremity", Chapter One, pp. 1–43 and 174–176.

"Clinical Measurement of the Axis of the Subtalar Joint", Phillips et al., Mar. 1975, pp. 119–131.

"Planal Dominance", Green et al., Feb. 1984, pp. 98–103.

*Primary Examiner*—Werner H. Schroeder

*Assistant Examiner*—Steven N. Meyers

*Attorney, Agent, or Firm*—Caesar, Rivise, Bernstein & Cohen, Ltd.

[57] ABSTRACT

In an article of footwear for use with a foot wherein the article has an upper portion and a sole. The sole has a forefoot and a rearfoot portion with the sole forefoot portion having a medial aspect and a lateral aspect. The sole forefoot portion is of varying thickness across the width thereof such that the sole slopes at an angle upwardly from the lateral aspect to the medial aspect to provide an inclined surface of greater thickness at the medial aspect than at said lateral aspect. This compensates the forefoot in its naturally inverted angulation and maintains the normal alignment, position, motion and function of the entire foot during use of said article of footwear.

8 Claims, 14 Drawing Figures

FOREFOOT COMPENSATED FOOTWEAR

BACKGROUND OF THE INVENTION

The present invention relates to new footwear compensating the foot to its environment.

The natural foot is angulated somewhat upward from the horizontal from its lateral side. The foot is inverted, or tilted, so that the plantar surface of the foot faces slightly toward the midline of the body and away from a transverse plane. In this regard, the foot and lower leg are still in a slightly varus attitude, generally bent inward, not unlike their position in the classical in utero fetal position.

The median sagittal plane is the midline of the body, which divides the body into equal right and left halves and touches the floor at a position midway between two parallel feet when the body is in an erect anatomical position. The foot also has a median sagittal plane which divides each foot into equal medial and lateral (left and right) halves or aspects. A sagittal plane itself is a flat plane passing through the body while in an erect anatomical position. The plane passes through the body in an anterior-posterior direction and divides the body into right and left parts, where the body is erect and the feet are parallel. A transverse plane is a flat, horizontal plane that lies parallel to the horizon and passes through the body in an erect anatomical position and which divides the body into superior (upper) and inferior (lower) parts.

The normal longitudinal axis of motion of the foot is a line that represents the ideal physical relationship of the osseous segments of the foot as they relate to foot function. The normal longitudinal axis of motion also indicates the preferred direction of vector forces generated through the foot for the production of maximum and optimum efficiency of foot function during static stance and locomotion. The longitudinal axis of motion and the median sagittal plane of the foot are normally in close proximity. The more closely that these two clinical entities are correlated and aligned; the more closely one achieves the ideal biophysical criteria for normal position, motion and function of the foot.

The foot and lower legs themselves have an inverted angulation which is residual from their fetal growth. In this regard the heel, (rearfoot), is slightly inverted to the transverse (horizontal) plane, approximately 4 degrees plus or minus amounts up to 2 degrees, on the average. This is commonly referred to as rearfoot or subtalar joint varus. The forefoot is inverted, additionally, to the rearfoot by an added amount of approximately 8 degrees plus or minus amounts up to 6 degrees, on the average. This is commonly referred to as forefoot or midtarsal joint varus. The lower legs are also slightly inverted to the ground by approximately 4 degrees plus or minus amounts up to 2 degrees, on the average, and this deviation is referred to as tibial or genu varum.

A weight-bearing foot on a flat surface, a horizontal flat plane, tends to pronate abnormally and excessively in order to compensate for these inverted angulations.

Excessive pronation is considered to be the unnatural position, motion, and function that the foot assumes when the foot is required to go through an excessive amount and range of motion in order to compensate for inherent anatomical variations or other planal predominances of the foot from flat surfaces. The weight-bearing vector forces of excessive pronation are generated more medially and away from the longitudinal axis of motion and the midline of the foot and are directed more toward the midline of the body.

Pronation is actually a complex simultaneous triplane motion generally in the direction of abduction, eversion and dorsiflexion. The axis of this motion passes through the foot from the posterior, lateral and plantar portions of the foot to the anterior, medial and dorsal portions of the foot.

The motion of normal pronation generally passes along the longitudinal axis of motion of the foot. A smooth movement of the foot, with a minimum of pronation occurs when weight-bearing forces directed through the foot pass closer to the longitudinal axis of motion and the median sagittal plane of the foot as the foot moves through the various stages of its gait.

An amount of rearfoot and forefoot pronation itself, (approximately 4 degrees to 6 degrees) is considered normal and is necessary for the foot to act as an effective shock absorber. Beyond that accepted amount, rearfoot and forefoot pronation is considered to be abnormal, excessive, and not within an acceptable range of motion.

Since nearly all individuals within the general population possess many different degrees of variations of foot types and amounts of abnormal pronation, ranging from slightly excessive to extremely excessive; it is the purpose and intention of the present invention to compensate for as much of these varying amounts that are in excess of the normal amount of allowable foot motion by prohibiting those additional amounts to occur. Excessive amounts of pronation usually fall within the range of from 2 degrees of 14 degrees of additional motion; that is, motion which is in excess of the allowable amount of 4 degrees to 6 degrees of normal motion (normal pronation). The excessive pronation of the weight-bearing foot on a flat surface comes about when the normal foot, which off weight-bearing, is slightly inverted, attempts to come down to meet and align itself with the ground (flat surfaces). In order to accomplish proper support, balance, equilibrium and ultimately propulsion, the rearfoot is required to follow the motion and action of the forefoot down to meet the ground from the inverted position and thus the entire foot pronates excessively. More specifically, the rearfoot goes through an excessive range of motion to allow this function and motion of the forefoot to occur due to the fact that rearfoot stability is dependent upon the structure and stability of the forefoot and vice versa. Ideally, the weight-bearing foot should be in its natural inverted plane at the time when it makes full contact with the surface upon which the foot bears and when it is fully weight-bearing.

Podiatric literature and the art of footwear deal with the foot in terms of the foot having abnormality in pronating excessively. Contrary to prior thought, whereby most feet were considered to be deviations of a "normal" foot type; abnormality actually resides in the fact that modern civilization and man's technological environment has provided unyielding, horizontal, flat surfaces for the foot and the footwear to adapt to; whereas, the natural, still-contoured foot is more suitably adapted to a pitched (inverted) surface environment. The foot, which is still in a period of evolutionary transition toward more efficient, upright bipedal locomotion, is consequently at a functional disadvantage, and to apply the inner border of the forefoot to a hard, flat walking or running surface; most individuals must pronate excessively. The modern human foot is, therefore, not suitable for use on a flat surface without some modification of the surface.

The present invention is for footwear which allows the foot to function in its natural inverted environment with the footwear adapted to the environmentally flat surface while the foot is able to comfortably be positioned in its natural position.

In the past, some recognition has been given to the angulation of feet, and particularly with regard to running shoes. The prior art concerned itself with changing the angular relationship between the heel and a flat surface. Subotnick in his U.S. Pat. No. 4,180,924 attempted to improve footwear by providing a running shoe with a wedge at the heel portion of the footwear. The wedge tended to compensate the heel to react to a flat surface in its attempt to avoid some excessive pronation. The emphasis seems to have been placed on compensating the heel since the heel in walking or running usually makes the first contact with the ground and is the area where excessive pronation is most obviously noticed.

Block in his U.S. Pat. No. 4,262,435 also discloses a compensated heel. Both Subotnick and Block substantially ignore compensating footwear at the forefoot and its relationship to excessive pronation.

It should be noted that Subotnick provides a transverse beveled sole tapering from the heel, past the arch, to its ending point, located immediately to the rear of the metatarsal-phalangeal joints (the ball of the foot). By the same token, Block's sole piece also has a relatively thickened body extending from the heel counter, forwardly and downwardly, and ending its taper also behind the metatarsal-phalangeal joints (the ball of the foot).

Footwear compensations of the past have attempted to correct the inverted heel, or otherwise have attempted to stabilize the rearfoot and thereby hoped to restrict or eliminate excessive pronation of the rearfoot. Such compensation, however, ignores the inverted forefoot which actually, and in fact, causes the resultant inward rolling and tipping of the subtalar and ankle joints (excessive rearfoot pronation) as the rearfoot rolls medially and everts following the movement of the inverted forefoot down to the ground.

It should be noted that in the prior art, compensation of the heel, while providing a substantially horizontal impact of the heel to a flat surface, does not compensate the inverted position of the forefoot, which, according to the prior art, still was subject to excessive pronation. Most rearfoot compensations of prior art shoes, in fact, tend to restrict the rearfoot's own natural inverted planal predominance that would otherwise allow the rearfoot to pronate amounts in order to act as an effective shock absorber when coming in contact with the ground.

According to the present invention new footwear is provided compensating the foot's natural angulation by providing an angulated sole sloping upward from the lateral aspect of the forefoot to the medial aspect, compensating the forefoot along the base and shafts of the metatarsal bones diagonally, the metatarsal-phalangeal joints (the ball of the foot), and the toes, giving the area beneath the first metatarsal-phalangeal joint (the big toe joint) the greatest elevation.

It has been found that the angulated wedge-shaped sole of the footwear of the present invention aligns the foot by compensating to angulate the forefoot to the heel and as a result, the entire foot to the ground for proper weight-bearing and even weight distribution. That is, the angulated wedge-shaped sole in the present invention compensates the forefoot and by so doing, whether the foot is standing still or in normal walking or running gait, weight-bearing forces directed through the foot pass closer to the median sagittal plane and the normal longitudinal axis of motion of the foot from rearfoot to forefoot. The footwear of the present invention compensates the foot to modern civilization's usually flat surfaces.

The advantages of the footwear of the present invention are that whether for normal standing, walking or for running, the footwear is adapted to the flat surface while the foot is maintained in its natural position. In standing, walking or running, excessive pronation is reduced, controlled or eliminated; the foot acts as a more immediate and effective fulcrum and lever for the walking or running step with the minimum waste of movement and distortion of the natural foot; and impact shock to the foot and the entire skeletal complex is minimized as the foot functions more efficiently and as a more effective shock absorber. The forward movement of the foot from the strike of the heel in its normal gait in walking or running proceeds to a flat contact of the footwear of the present invention with a flat surface during its fully weight-bearing midstance phase of gait; while the foot itself, having a minimum of pronation, functions at its optimum since the footwear itself has been adapted to the flat surface.

The footwear of the present invention has a more even and harmonious contact with a flat surface and the push-off phase of the gait is more firmly focused on the first metatarsal-phalangeal joint (big toe joint) with the weight-bearing gravitational forces being more evenly directed through the foot for most optimum, efficient, and effective standing, walking, or running. In addition to the vast majority of individuals with varsus (inverted) foot and leg types (approximately 95 percent of the entire population) who would benefit from the advantages of the present invention; firmly focusing the propulsive forces on the first ray segment of the foot becomes a distinct and added advantage to those individuals who also possess the anatomical variation of hypoplasia (shortness) of the first metatarsal bone (which clinical entity is seen in approximately another 60 percent of the general population).

It has been found that, on the average, 4 degrees to 8 degrees of angulated compensation of the forefoot from the lateral aspect of the footwear to the medial aspect of the footwear seems to be preferred. The area of compensation angulates and slopes upward and toward the medial aspect of the footwear in all directions from its vertex at the area beneath the lateral aspect of the fifth metatarsal-phalangeal joint. It then radiates from proximally to distally from this vertex and at the same prescribed angle to encompass the following areas of the forefoot: (1) the area beneath the base if the fifth metatarsal bone; (2) the area diagonal to the longitudinal and transverse arches of the foot and shafts of the metatarsal bones; (3) the areas beneath the five metatarsal-phalangeal joints (the ball of the foot); (4) the area beneath all of the toes.

Compensating between 8 degrees plus or minus amounts up to 6 degrees provides good results at the medial aspect of the footwear. This provides an angular range and sets parameters of not less than 2 degrees nor more than 14 degrees of forefoot varus compensation.

For example, a sole of a shoe of a particular size, width, and style may slope from a thickness of $\frac{3}{8}$ of an inch greater on the medial aspect at the forefoot of the footwear to the lateral aspect at the forefoot of the footwear providing an 8 degree angle; while in yet another shoe of a different size and width, the sole of this same style shoe, may slope from this same thickness of $\frac{3}{8}$ of an inch greater on the medial aspect than on the lateral aspect at the forefoot of the footwear providing yet a different angle. This is also true in examples where the angle of the forefoot compensation remains constant while the thickness achieved at the medial aspect varies; again depending on the size, width, and style of the particular footwear. In each and every example, however, the relative thickness of the forefoot compensation at the medial aspect of the footwear is always thicker than that at the lateral aspect of the forefoot of the footwear by the prescribed amount.

In effect, for such shoes, $\frac{3}{8}$ of an inch, plus or minus, amounts up to 5/16 of an inch usually provides angular equivalents of 8 degrees plus or minus amounts up to 6 degrees. An angular range of from 2 degrees to 14 degrees of forefoot varus wedge compensation or a dimensional range of from 1/16 of an inch to 11/16 of an inch (approximately 0.16 centimeters to approximately 1.74 centimeters) of thickness, greater on the medial aspect than on the lateral aspect of the forefoot; would, under most circumstances, achieve the desired results.

These parameters are necessary and adviseable in order to be able to gradually introduce the novel and revolutionary concept of the present invention into widespread usage among the general population; since it is often necessary to gradually increase the amount of forefoot varus wedge angulation in moderate increments, slowly, and over a gradual period of time in order of effectively achieve greater compliance and acceptance of the concept with fewer side effects, less discomfort, and shorter periods of adjustment.

It may also be necessary and adviseable for certain individuals to be afforded the opportunity to obtain different, varying, and/or graded amounts of forefoot varus compensation in a manner similar to the present day shoe size and width selections or in the form of prescription footgear when their particular needs fall outside of the usual and customary 4 degrees to 8 degrees average range of inverted forefoot varus angulation.

The sole of the footwear of the present invention is also beveled from the heel down toward the toes on the lateral aspect. This longitudinal bevel created by the taper of the wedge of the forefoot compensation of the present invention is similar to the effect of the conventional heel lift. Thus whether in walking or running as the footwear makes contact with the ground starting at the heel, the footwear moves forward with generally flat, smooth, the congruous impact with a flat surface. This longitudinal bevel effectively creates even greater heel lift and elevation of the rearfoot in addition to that of the conventional heel lift. This further reduces the weight on the heel and decreases heel, foot, leg, and back discomfort when one is standing still. This feature additionally tends to enhance the conventional heel lift by propelling the body forward during the act of locomotion, thus adding to the increased efficiency of walking or running, and producing faster walking or running elapsed times so important to the competitive athlete. This feature is also more consistent and compatible with the evolutionary trend toward increased equinus of the human foot; a theory proposed by careful observes in the fields of organic evolution and physical and cultural anthropology.

Although such novel feature or features believed to be characteristic of the invention are pointed out in the claims, the invention and the manner in which it may be carried out may be further understood by reference to the description following and the accompanying drawings.

Figure 9:
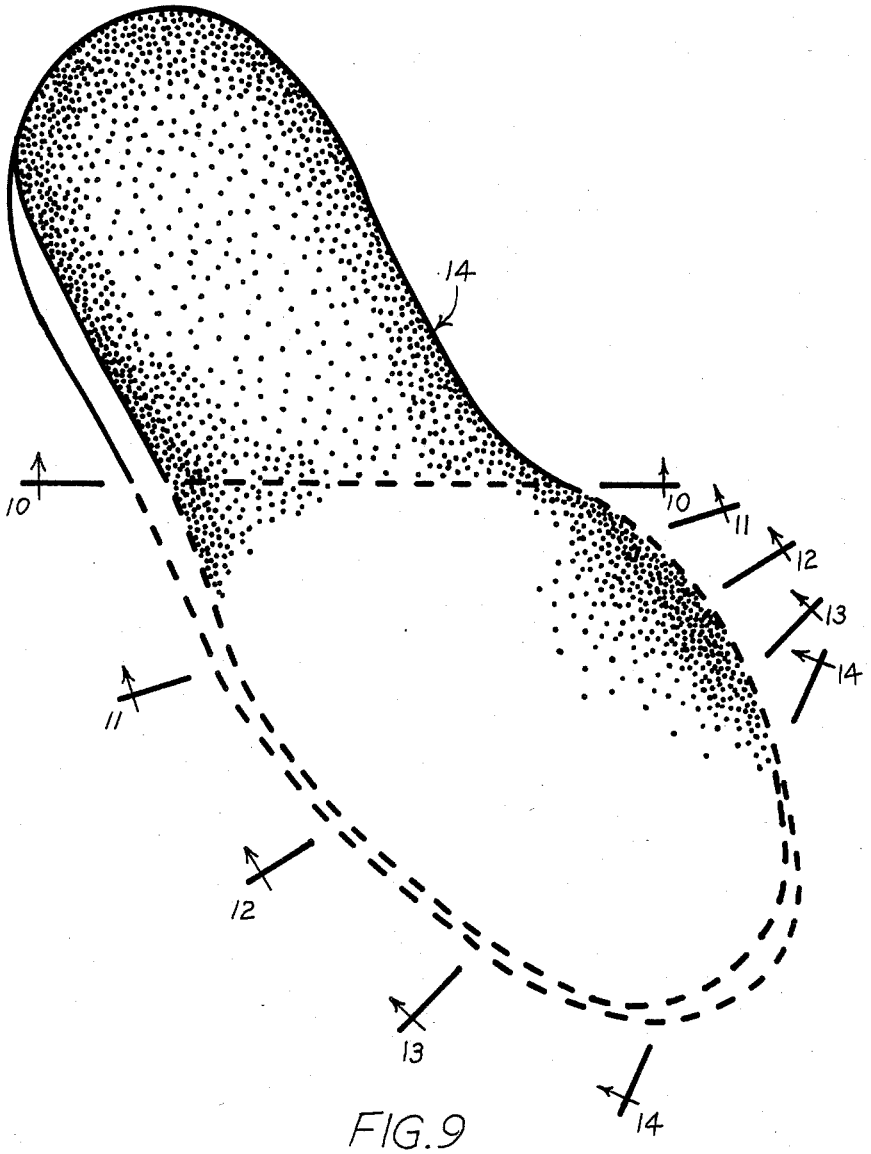
FIG. 9 is a perspective plan view of a right midsole of the present invention showing the area of the forefoot compensating wedge of the midsole in phantom and defined by the dotted areas.
Figure 10:
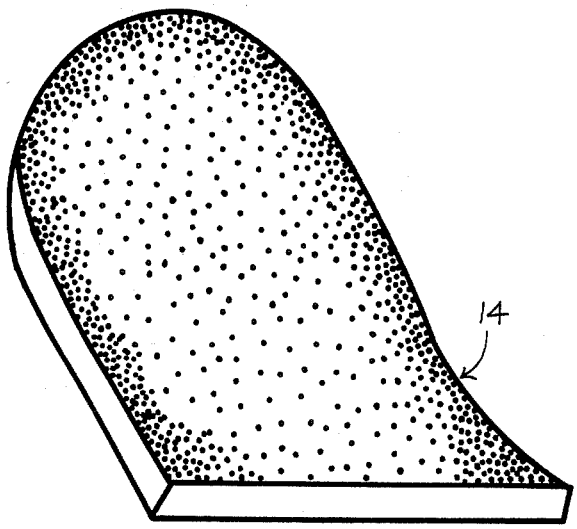
Figure 11:
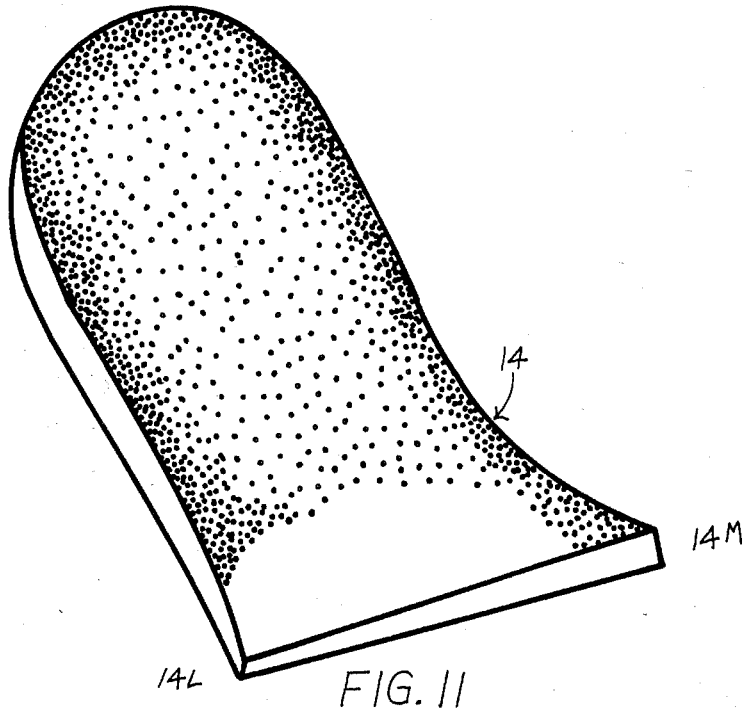
Figure 12:
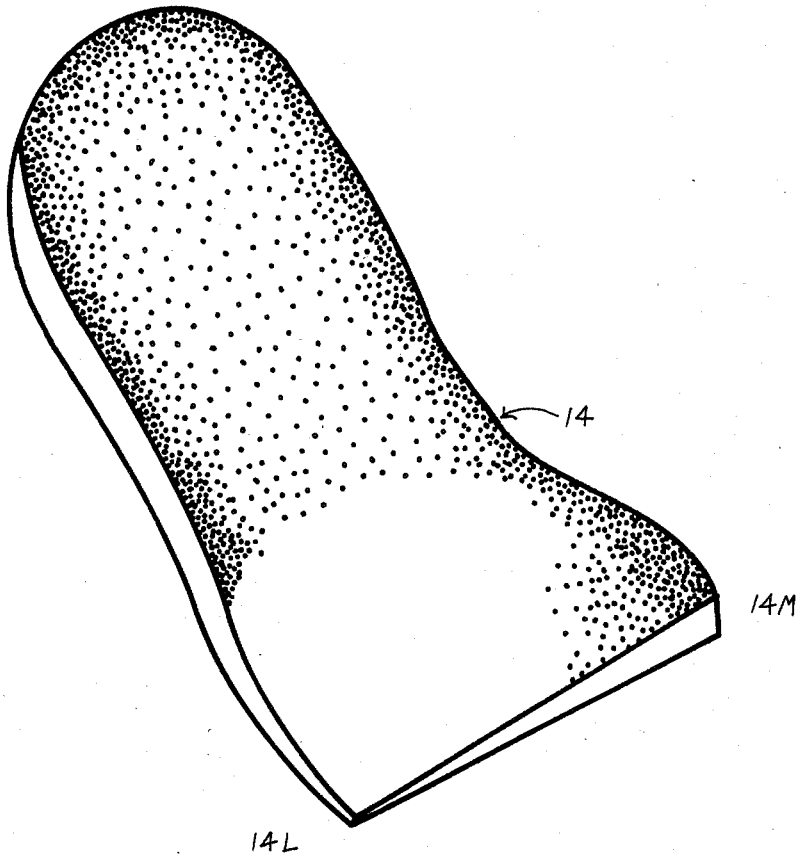
Figure 13:
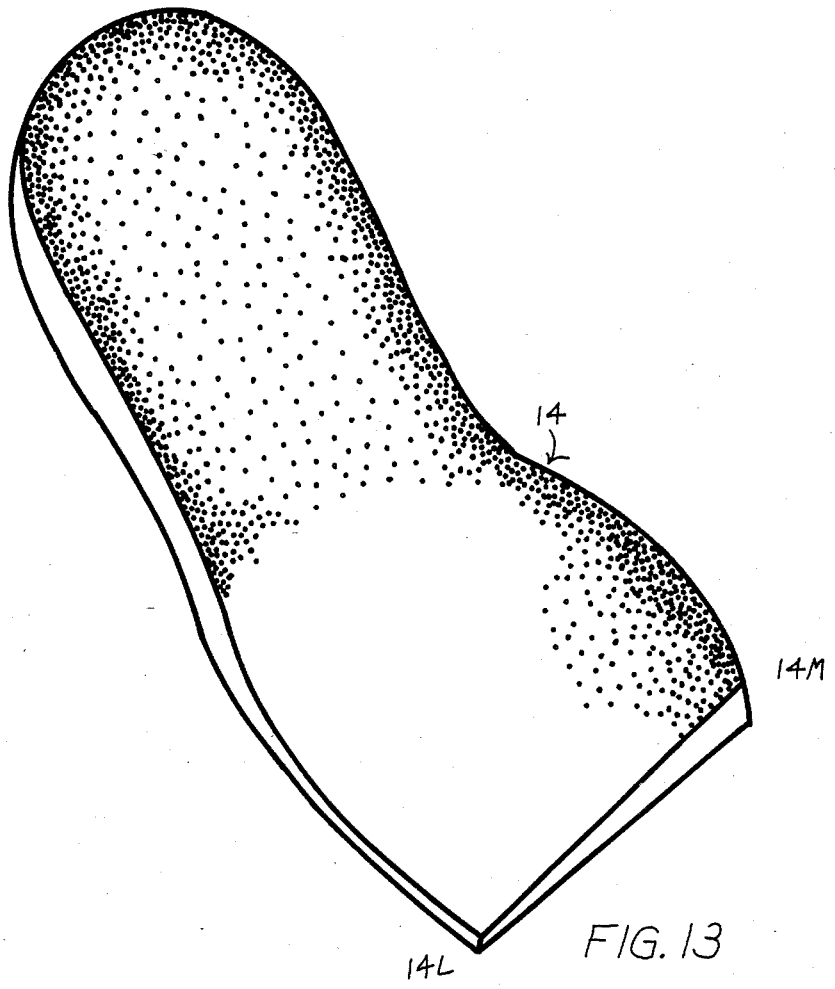
Figure 14:
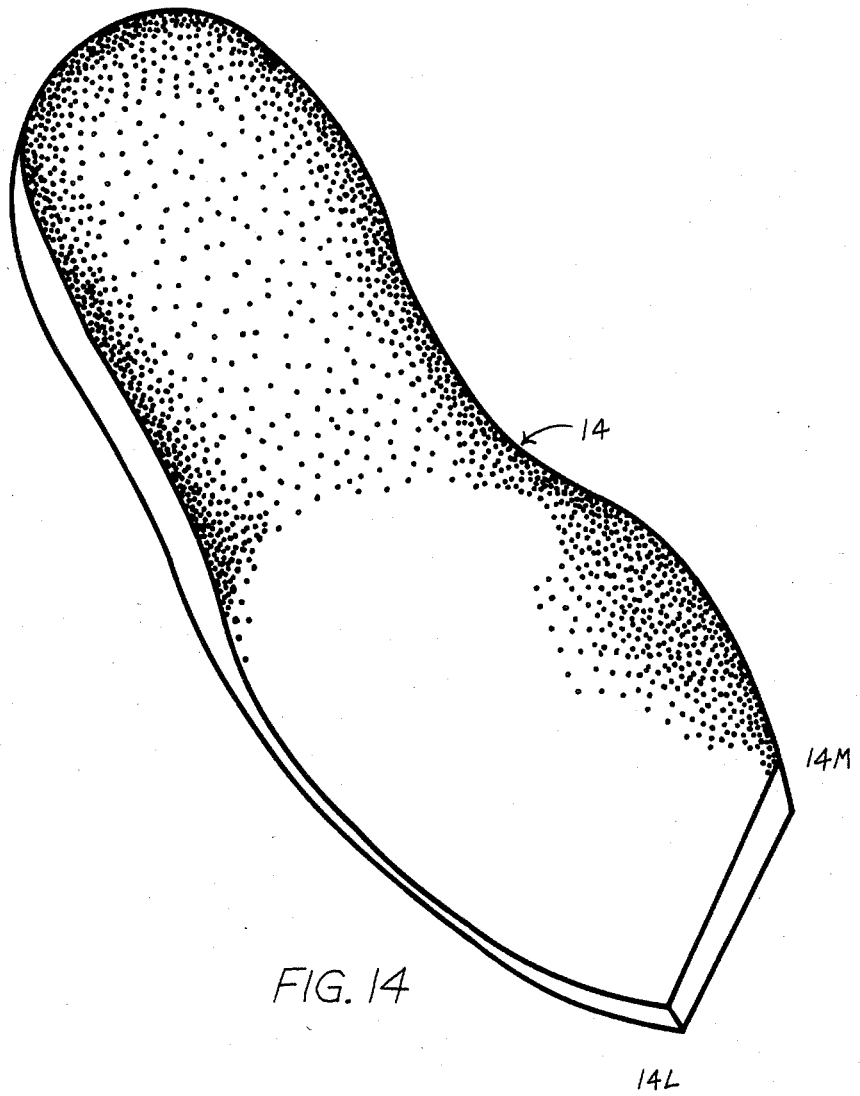

FIGS. 10 through 14 are perspective plan views along lines 10—10 through 14—14 of FIG. 9.

Referring now to the figures in greater detail, where like reference numbers denote like parts in the various figures.

As shown in the figures, an article of footwear 10, has a conventional upper 11 and a sole 12. The sole 12, exemplified in these particular drawings as a running shoe, includes an outer sole 13 and a midsole portion 14. The midsole 14 as shown in the drawings is labeled 14L and 14M to correspond with the lateral aspect and medial aspect of the midsole, respectively. When referred to as the midsole 14, the midsole is to be considered in its entirety. The midsole portion of a running shoe also usually incorporates a heel elevation wedge 17 similar to a conventional heel lift. The outer sole may include gripping surfaces 15.

Some articles of footwear may also have an innersole. Innersoles, midsoles, and/or outersoles may each become an integral part of the present invention depending on the particular type of footwear construction. In a running shoe, as exemplified in these particular drawings, the compensation of the present invention is incorporated directly into the midsole 14 with the innersole and outersole being only secondarily affected by the compensation of the midsole itself.

Figure 1:
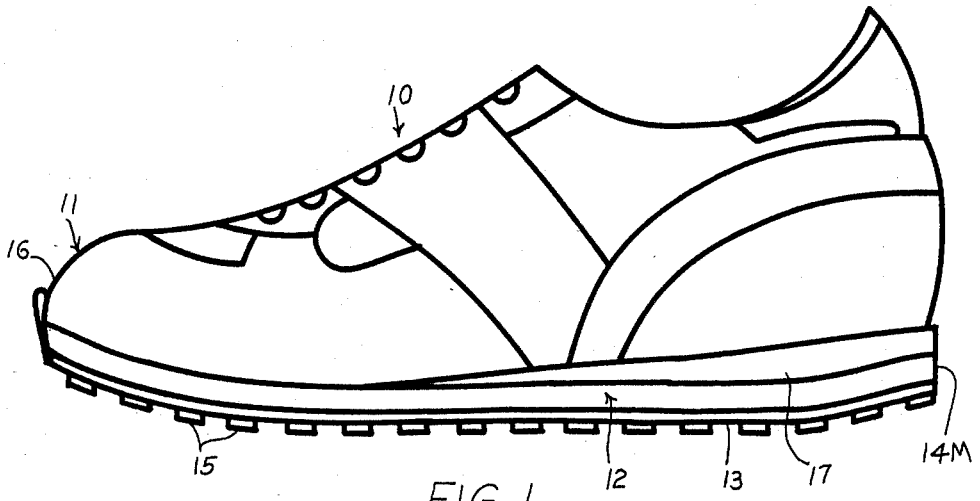
FIG. 1 is a left-side (medial) elevation of a right foot article of footwear of the present invention.
Figure 2:
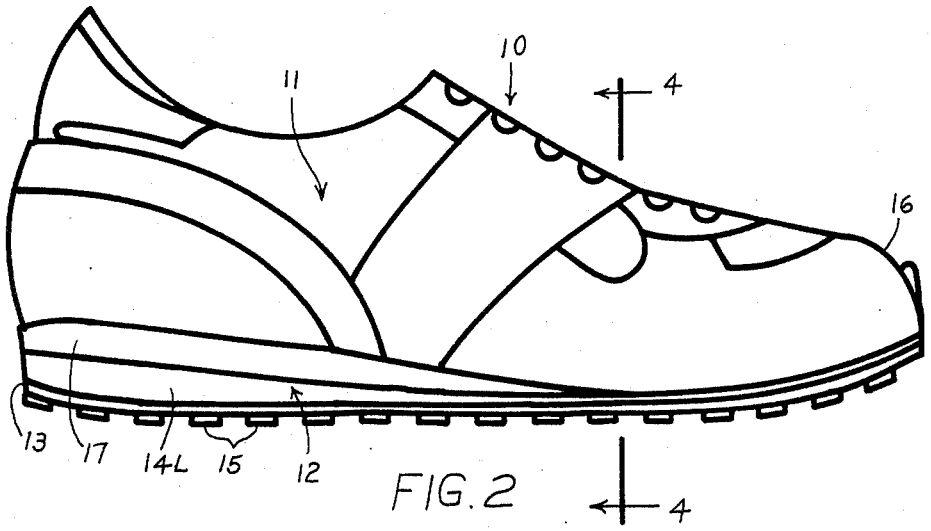
FIG. 2 is a right-side (lateral) elevation of the article of footwear of FIG. 1.

The heel elevation 17, as shown, tapers on both the medial and lateral aspects of the footwear from the heel towards the toe 16, as can be seen in both FIG. 1 and FIG. 2. This longitudinal taper brought about by the use of a conventional prior art heel elevation is not integral to the present invention. The present invention functions equally well in the environment of a flat sole or higher heel shoe and is essentially not affected by the relative height of the heel or sole of the shoe.

The midsole 14, as shown, tapers on the lateral aspect (14L) from the heel towards the toe 16 as can be seen in FIG. 2. This longitudinal taper of the midsole 14L, only on the lateral aspect, is created by the forefoot compensating wedge of the present invention and it is in addition to the taper of the conventional heel elevation 17. This added longitudinal taper created on the lateral aspect is integral to the present invention and desirable for increased efficiency of walking or running.

Figure 3:
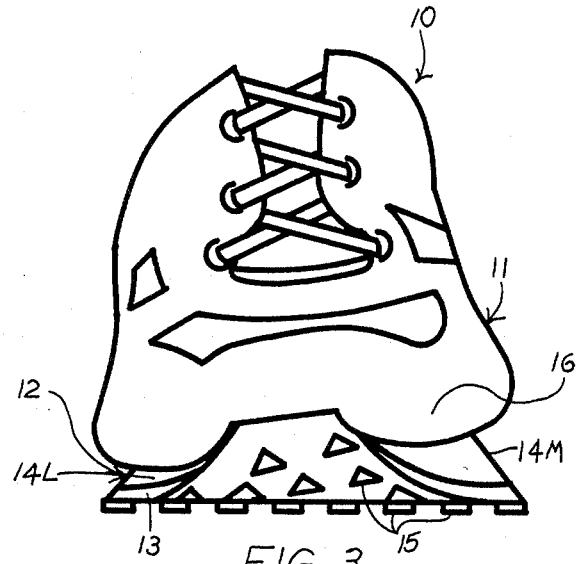
FIG. 3 is a front elevation of the article of footwear of FIG. 1.
Figure 4:
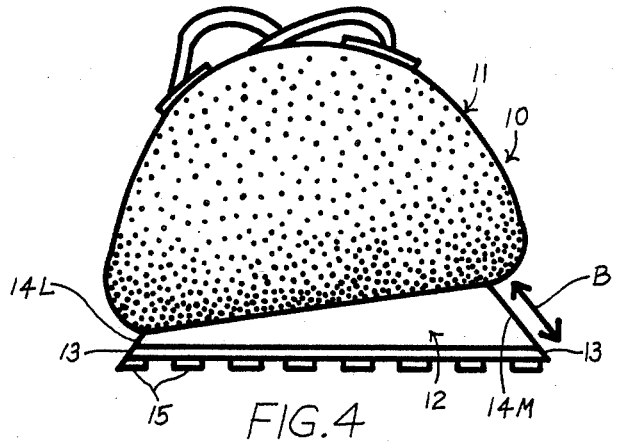
FIG. 4 is a section of FIG. 2 along lines 4—4.

The thickness of the sole slopes upward from the lateral aspect of the forefoot of the footwear, to a height of $\frac{3}{8}$ of an inch plus or minus amounts up to 5/16 of an inch greater at the medial aspect in the area beneath the first metatarsal-phalangeal joint of the foot than at the lateral aspect, as can be seen at line B in FIG. 4. FIG. 4 is a section of FIG. 2 along lines 4—4. This graded thickness of the forefoot compensating wedge can also be observed by comparing the forefoot midsole sections 14L and 14M as illustrated in FIGS. 1, 2, and 3, each one to the other.

In other articles of footwear, in which types of construction there is no midsole, the forefoot compensation of the present invention would be incorporated directly into either the innersole or the outersole of the footwear itself.

Figure 6:
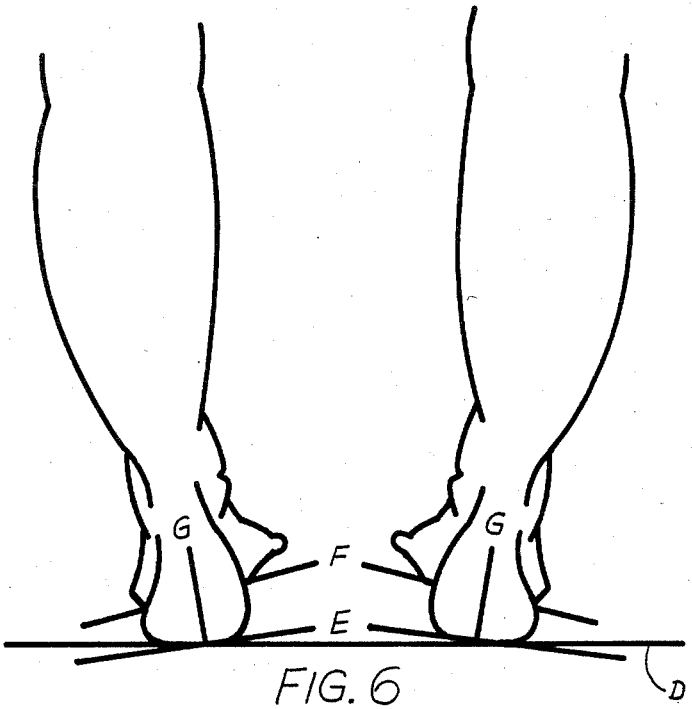
FIG. 6 is a rear view of dangling, off weight-bearing, feet showing the normal and average inversion of a foot relative to a flat surface.
Figure 7:
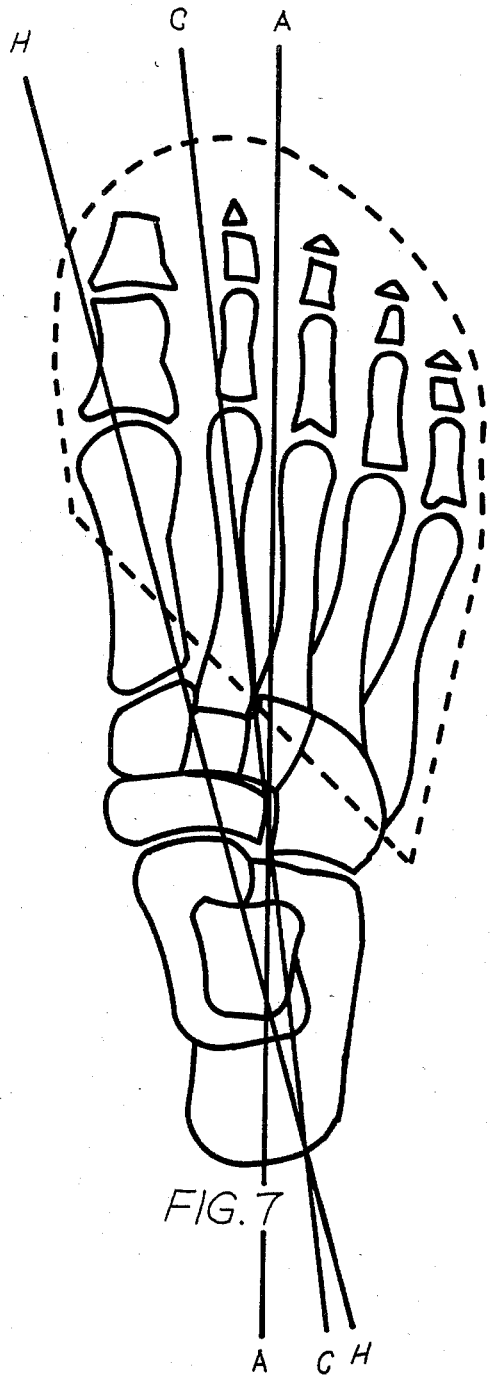
FIG. 7 is a plan view of a skeletal right foot showing the area of forefoot compensation of the footwear of the present invention as defined by the dotted area, along with lines denoting the median sagittal plane (A), the normal longitudinal axis of motion (C), and the medially displaced longitudinal axis of abnormal and excessive pronation (H), drawn through the foot.

The area of the forefoot to be compensated in the shoe is shown in FIGS. 7 and 9, as defined by the dotted areas. FIG. 7 shows the area of forefoot compensation in its relationship to the metatarsal bones, joints, and toes of a right foot. FIG. 9 shows the area of forefoot compensation of a right shoe midsole. The upsloping of the sole at the medial aspect of the forefoot to a height of $\frac{3}{8}$ of an inch, plus or minus amounts up to 5/16 of an inch, generally provides an angulation of 8 degrees plus or minus amounts up to 6 degrees beneath the ball and toes of the foot. The midsole 14, at the area of the metatarsal-phalangeal joints of a foot, lines 4—4 in FIG. 2, slopes at an angle preferrable of about 8 degrees, plus or minus amounts up to 6 degrees, so that the forefoot, in the footwear 10, has the metatarsal bones, metatarsal-phalangeal joints, and toes of the foot aligned at the normal natural angle of the foot, substantially as shown in FIG. 6, which shows the natural position of the feet.

Figure 5:
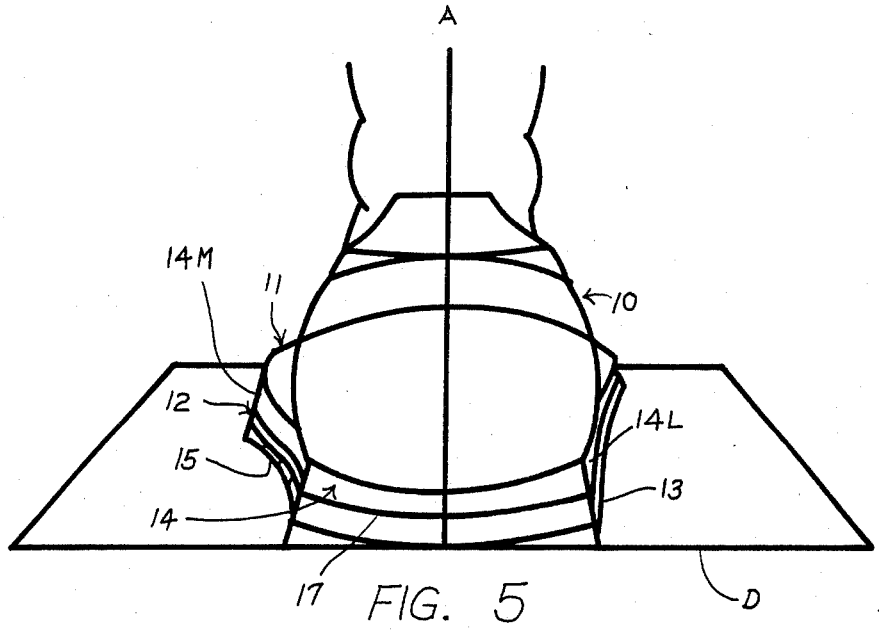
FIG. 5 is a rear view of a right foot article of footwear of the present invention fully weight-bearing in the midstance phase of gait.

In FIG. 6, line D represents a horizontal plane. Lines E and G show the normal and average inversion of the rearfoot relative to the horizontal plane D. This inversion is oftentimes referred to as rearfoot or subtalar joint varus. Line F represents the normal and average forefoot inversion. It is in addition to the inversion of the rearfoot (lines E and G) and is generally referred to as forefoot or midtarsal joint varus. The position of the feet in FIG. 6 represents the natural position of the feet with their normal and average amounts of inherent inversion. That is, the non-weight-bearing or dangling position of the feet in their naturally inverted relationship to a flat surface. The natural position of the foot, particularly the forefoot, is essentially unchanged within the shoe when weight-bearing and wearing the footwear 10 of the present invention, such as shown in FIG. 3. FIG. 5 also shows the foot in its natural position when fully weight-bearing; however, it should be noted that the normal amount of rearfoot motion, in the form of normal pronation has been allowed to occur in the foot's position in FIG. 5. This change in rearfoot position, motion, and function in the form of normal pronation can be noted by comparing the naturally inverted position of the rearfoot depicted by line G in FIG. 6, to its perpendicular (square and level) position denoted by line A in FIG. 5. While this normal amount of pronation has been allowed to occur when wearing the footwear 10 of the present invention it will be noted that the foot is without any excessive pronation. Prior art rearfoot compensations, particular Subotnick in his U.S. Pat. No. 4,180,924 and Block in his U.S. Pat. No. 4,262,435 restricted this normal rearfoot function in their attempt to control or eliminate excessive rearfoot pronation. Abnormal and excessive pronation of other prior art footwear, whether rearfoot compensated or not, is shown by comparing the medially displaced line H in FIG. 8, representing an excessive amount of pronation in prior art footwear, to line A in FIG. 5, showing no abnormal or excessive pronation of the footwear 10 of the present invention.

Line A in FIG. 5 is the median sagittal plane and bisection of the heel as viewed from the rear and is the same line as line G in FIG. 6; having allowed, however, for the heel (rearfoot) to move its anticipated and normal amount from its naturally inverted off weight-bearing position, line G in FIG. 6, to its fully weight-bearing midstance position, line A in FIG. 5. Line A in FIG. 5 is also the same line and in the same plane as Line A, the median sagittal plane of the foot, as shown in FIG. 7, viewed from the top rather than from the rear.

Figure 8:
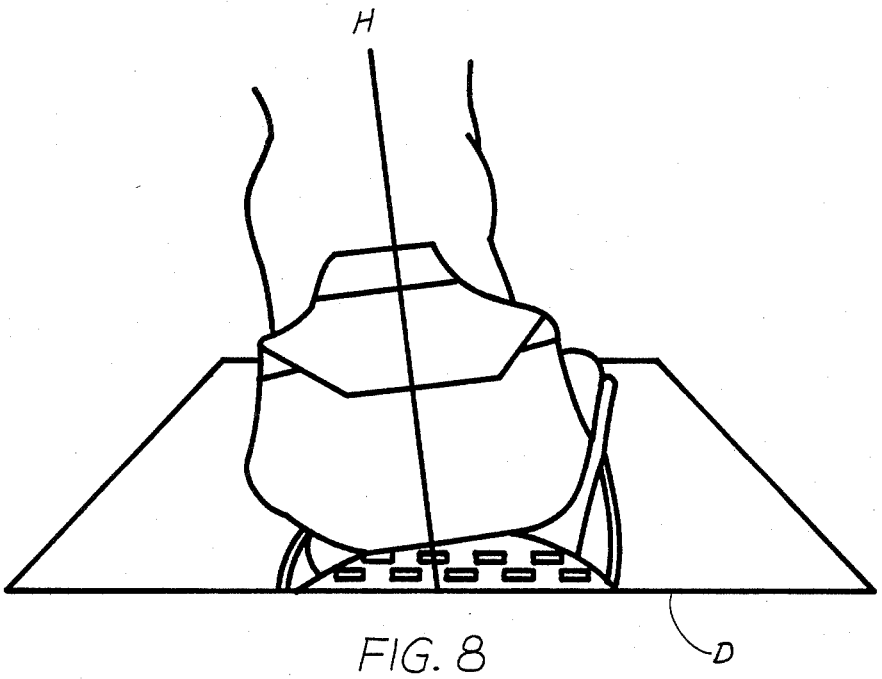
FIG. 8 is a rear view of a right foot article of prior art footwear abnormally and excessively pronated when fully weight-bearing in the midstances phase of gait.

Line H in FIG. 8 is a rear view of the medially displaced longitudinal axis of abnormal and excessive pronation of prior art footwear and is also the same line shown in the same plane as line H in FIG. 7, as viewed from the top rather than from the rear.

It will be noted that the longitudinal axis of abnormal and excessive pronation, line H in FIG. 7, is medially displaced from both the normal longitudinal axis of motion, line C in FIG. 7, and the median sagittal plane of the foot, line A in FIG. 7. The more these lines are divergent; the greater the amount of abnormal and excessive pronation is present in the foot. The more closely that these lines are aligned; the more closely one achieves the ideal biophysical criteria for normal position, motion, and function of the foot.

Lines D as shown in FIGS. 5, 6, and 8 represents a horizontal, flat surface and are the same lines in the same plane and remain constant.

FIG. 9 shows a right shoe midsole 14 in perspective view and in phantom with a forefoot compensating varus wedge 18. The sections of the midsole 14 as shown in FIG. 10 through 14 show the preferred embodiment of the forefoot compensating wedge which generally increases in thickness from the lateral aspect to the medial aspect as shown in sections 11 through 14. The area of the forefoot compensation from proximal to distal encompasses the area beneath the base of the fifth metatarsal bone, the area diagonal to the longitudinal and transverse arches of the foot and shafts of the metatarsal bones, the areas beneath the five metatarsal-phalangeal joints (the ball of the foot), and the area beneath all of the toes and extending to the tips of the toes. This area corresponds to the dotted area as shown in FIG. 7 and FIG. 9.

It has been found that a sole 12 thickness of $\frac{3}{8}$ of an inch plus or minus amounts up to 5/16 of an inch greater at the medial aspect of the forefoot than at the lateral aspect of the forefoot is adequate to slope the sole at the 8 degree plus or minus amounts up to 6 degrees preferred angle towards the fifth metatarsal bone and fifth toe (little toe), depending, of course, on the footwear's size and width. As the footwear's size and width gets larger, the thickness of the forefoot compensation at the medial aspect of the footwear naturally increases, even within the same style of footwear, while the angle of the forefoot compensation remains the same.

With the sole 12 thus sloped and the metatarsal bones, joints, and toes angulated at an angle of 8 degrees plus or minus amounts up to 6 degrees; the footwear and foot, in standing or a walking or running gait, contacts a flat surface, as shown in FIGS. 3 and 5, with the body weight and gravitational forces directed through the foot moving forward in the footwear 10 onto and through weight-bearing positions with the bearing of the weight and forces passing close to the median sagittal plane as shown by lines A in FIGS. 5 and 7 and close to the normal longitudinal axis of motion of the foot (line C of FIG. 7) from rearfoot to forefoot with no heel counter distortion or excessive pronation (lines H in FIGS. 7 and 8).

The compensation of the forefoot naturally maintains the position and alignment of the rearfoot, placing the substantially flat outer surface of the outersole 13 against a substantially flat surface, a horizontal plane, while the structure of the foot is held in alignment close to the median sagittal plane, lines A in FIGS. 5 and 7, and with motion and function being directed close to the longitudinal axis of motion, line C in FIG. 7, not withstanding the normal inverted position of the forefoot as shown in FIG. 6.

The footwear 10 of the present invention thus substantially eliminates excessive pronation of the foot in the footwear and creates a more effective and efficient contact, gripping, and propulsive surface at a right angle and square and level, to the weight-bearing plane, lines A and D in FIG. 5.

As the foot pushes off, using the first metatarsal-phalangeal joint and the ball of the foot as a fulcrum and lever for the step, substantially full propulsion of the step is made without excessive pronation as is noted by comparing the relationship of lines A and D in FIG. 5, to the relationship of lines H and D in FIG. 8.

The footwear 10 of the present invention serves to allow the foot to function as a loose adaptive shock absorber by allowing normal amounts of foot motion, in the form of normal pronation, to occur. It also serves to allow the forefoot to function as a rigid propulsive lever at a specific instance during the gait cycle while not allowing excessive amounts of pronation to occur. This is particularly so when the foot is required to meet hard, flat, and unyielding surfaces.

The terms and expressions which are employed herein are used as terms of description only and it is recognized that various modifications are possible within the scope of the invention claimed.

It is understood the following claims are intended to cover all of the generic and specific features of the invention herein described, and all statements of the scope of the invention which, as a matter of language, might fall therebetween.

Without further elaboration the foregoing will so fully illustrate my invention that others may, by applying current or future knowledge, readily adapt the same for use under various conditions of service.

I claim:

1. In an article of footwear for use with a foot, said article having an upper portion and a sole, said sole having a forefoot and a rearfoot portion, said sole forefoot portion having a medial aspect and a lateral aspect, said sole forefoot portion being of varying thickness across the width thereof such that said sole slopes at an angle upwardly from said lateral aspect to said medial aspect to provide an inclined surface of greater thickness at said medial aspect than at said lateral aspect to compensate said forefoot in its naturally inverted angulation and to maintain the normal alignment, position, motion and function of the entire foot during use of said article of footwear, and wherein said inclined surface compensates the forefot beneath the base and shafts of the metatarsal bones diagonally, the metatarsal-phalangeal joints (the ball of the foot), and the toes, giving the area beneath the first metatarsal-phalangeal joints (the big toe joint) the greatest elevation, and wherein said sole rearfoot portion is of constant thickness, such that the rear portion of the foot is allowed to act as an effective shock absorber when coming into contact with the ground, and wherein said inclined surface has a slope at a maximum angle of 8 degrees plus or minus amounts up to 6 degrees.

2. The sole of claim 1 wherein said inclined surface has a preferred slope at a maximum angle of 4 degrees to 8 degrees.

3. The sole of claim 1 wherein said inclined surface slopes at a maximum angle of no less than 2 degrees.

4. The sole of claim 1 wherein said inclined surface slopes at a maximum angle of no more than 14 degrees.

5. The sole of claim 1 wherein the maximum thickness of said sole forefoot portion is preferrably at a height of $\frac{1}{4}$ inch to $\frac{3}{8}$ inch greater at the medial aspect than at the lateral aspect.

6. The sole of claim 1 wherein the maximum thickness of said sole forefoot portion of $\frac{3}{8}$ inch plus or minus amounts up to 5/16 inch greater at the medial aspect than at the lateral aspect.

7. The sole of claim 1 wherein the maximum thickness of said sole forefoot portion is no less than 1/16 inch greater at the medial aspect than at the lateral aspect.

8. The sole of claim 1 wherein the maximum thickness of said sole forefoot portion is no more than 11/16 inch greater at the medial aspect than at the lateral aspect.

* * * * *